United States Patent [19]

Williams et al.

[11] 4,232,362

[45] Nov. 4, 1980

[54] FAMILY OF MODULAR LAMPS FOR INDIRECT LIGHTING

[75] Inventors: Thomas A. Williams, Wakefield, Mass.; Alfred O. Scholze, New Canaan, Conn.

[73] Assignee: Lam, Inc., Wakefield, Mass.

[21] Appl. No.: 948,679

[22] Filed: Oct. 5, 1978

[51] Int. Cl.[3] ..... F21S 1/12

[52] U.S. Cl. ..... 362/410; 362/122; 362/145; 362/367; 362/801; 362/806

[58] Field of Search ..... 362/122, 127, 134, 145, 362/311, 312, 315, 322, 362, 367, 375, 410, 413, 414, 801, 806

[56] References Cited

U.S. PATENT DOCUMENTS

| | | | |
|---|---|---|---|
| 2,720,056 | 10/1955 | Levy | 362/122 |
| 3,451,881 | 6/1969 | Gurule | 362/806 |
| 3,798,438 | 3/1974 | Menichetti | 362/806 |
| 4,117,533 | 9/1978 | Hazelthorn | 362/367 |
| 4,121,279 | 10/1978 | Whitesel | 362/811 |

*Primary Examiner*—Donald P. Walsh
*Attorney, Agent, or Firm*—Charles E. Pfund

[57] ABSTRACT

A family of modular lamps for indirect lighting, each comprised of stacked modules connected with spaces between the bottoms and tops of adjacent modules, the bottom of the lowest module of a stack of modules providing a base upon which the stand rests and the top of the uppermost module containing a recess and support therein for receiving an indirect lighting unit which directs light upwardly through the open top of the top module.

27 Claims, 7 Drawing Figures

FAMILY OF MODULAR LAMPS FOR INDIRECT LIGHTING

BACKGROUND OF INVENTION

Indirect lighting is not new. Such lighting has been widely adopted as a means of illumination and, for domestic and display purposes, an inverted reflector is used secured to the upper end of a stand so as to direct light upwardly toward the ceiling. It is the purpose of this invention to employ the kind of indirect lighting where the reflector is inverted to direct the light toward the ceiling in combination with lamp stands comprised of stacked modules of predetermined different configurations which enables grouping lamp stands of several different predetermined configurations not only to provide a unique display of lamps, but also to produce unique lighting and, at times, by simple substitution of plants for some of the lighting, provide in combination an indirectly lighted plant display. Further objects of the invention are to provide modular lamp stands wherein the basic modular construction can be inexpensively molded and easily assembled to provide distinctiveness.

SUMMARY OF INVENTION

As herein illustrated, the invention comprises in one form an indirect lighting system comprised of stacked modules, each of which is a hollow, thin wall structure of block-like configuration, a band associated with each module which fits the perimeter thereof, said band being adapted to interconnect two of said modules in spaced relation by attachment to the respective top and bottom peripheries of each of two adjacent modules, structural members on the inner walls of said modules and means for attaching a band between two adjacent modules to the respective structural members in each module to form an assembly of spaced modules. The top module contains a recessed support and a light-emitting assembly comprising a reflector and lamp socket is mounted to the support in the recess so as to direct light upwardly through the open top. Optionally, the light-emitting assembly may be replaced with a receptacle for receiving a potted plant so that the foliage thereof projects upwardly through the open top. Ballast is recessed into the bottom module for the lighting circuit and to stabilize the lamp stand. Desirably, a plurality of modules are stacked to provide a floor module with the top module high enough so that the light emitted therefrom is above eye level. In one form of floor model, all of the modules are the same size and, in another form, a single module of unit size is mounted atop a module of multiple unit size. Alternatively, one or more single modules of unit size may be stacked, a post secured at its lower end to the stacked modules and a single unit module attached to the top of the post above the stacked modules at the bottom of the post. It is also within the scope of the invention to mount a single unit module which contains a light-emitting assembly and ballast at a height above eye level for obtaining indirect lighting, for example, in an existing structure. The modules may be of circular or square or other cross section and each module is made of two identical molded halves symmetrically positioned in abutting engagement and bonded to each other. In accordance with the invention, lamp stands constructed of the modules as aforesaid are used individually or in groups of different height and cross-sectional configuration to obtain both unique displays and to provide the desired levels of intensity of illumination at the work plane while achieving a satisfactory range of brightness on the ceiling.

The invention will now be described in greater detail with reference to the accompanying drawings, wherein.

Figure 6:
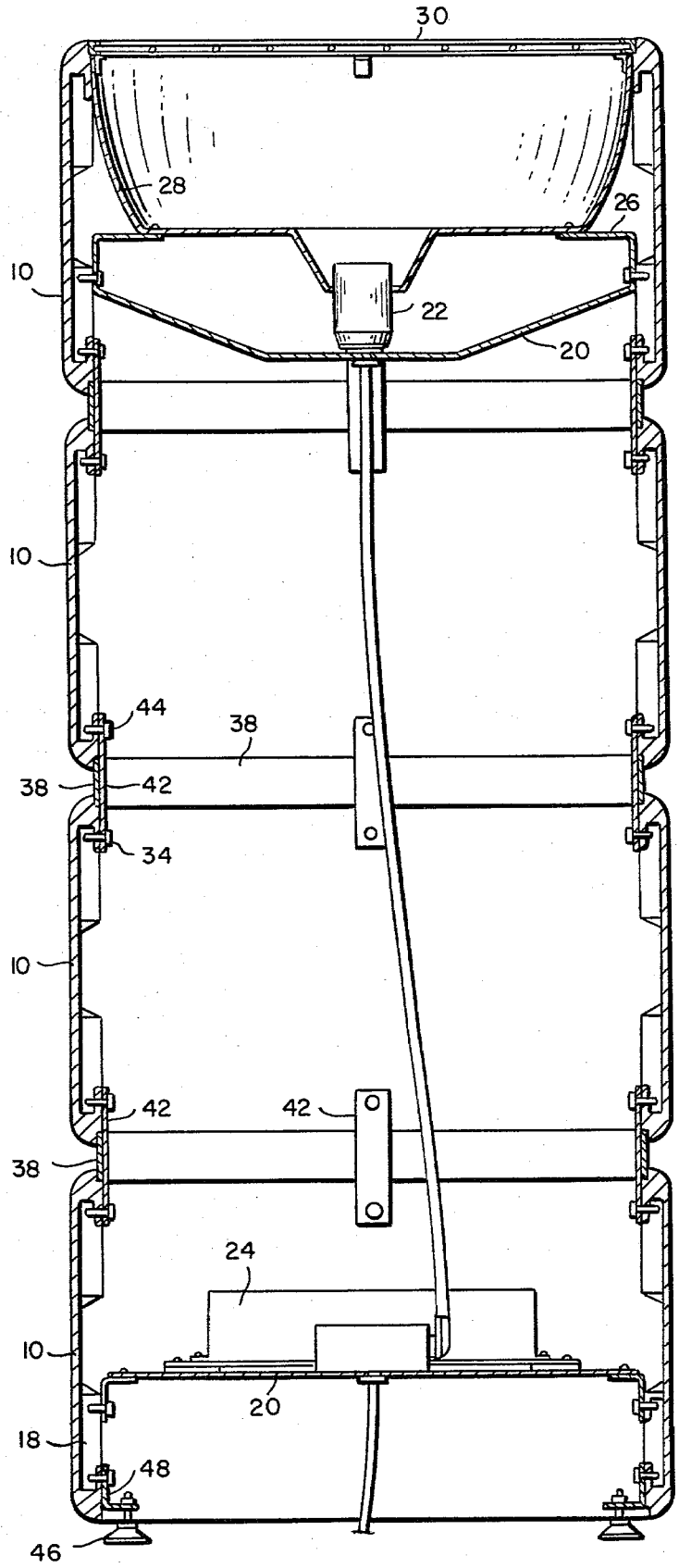
Figure 7:
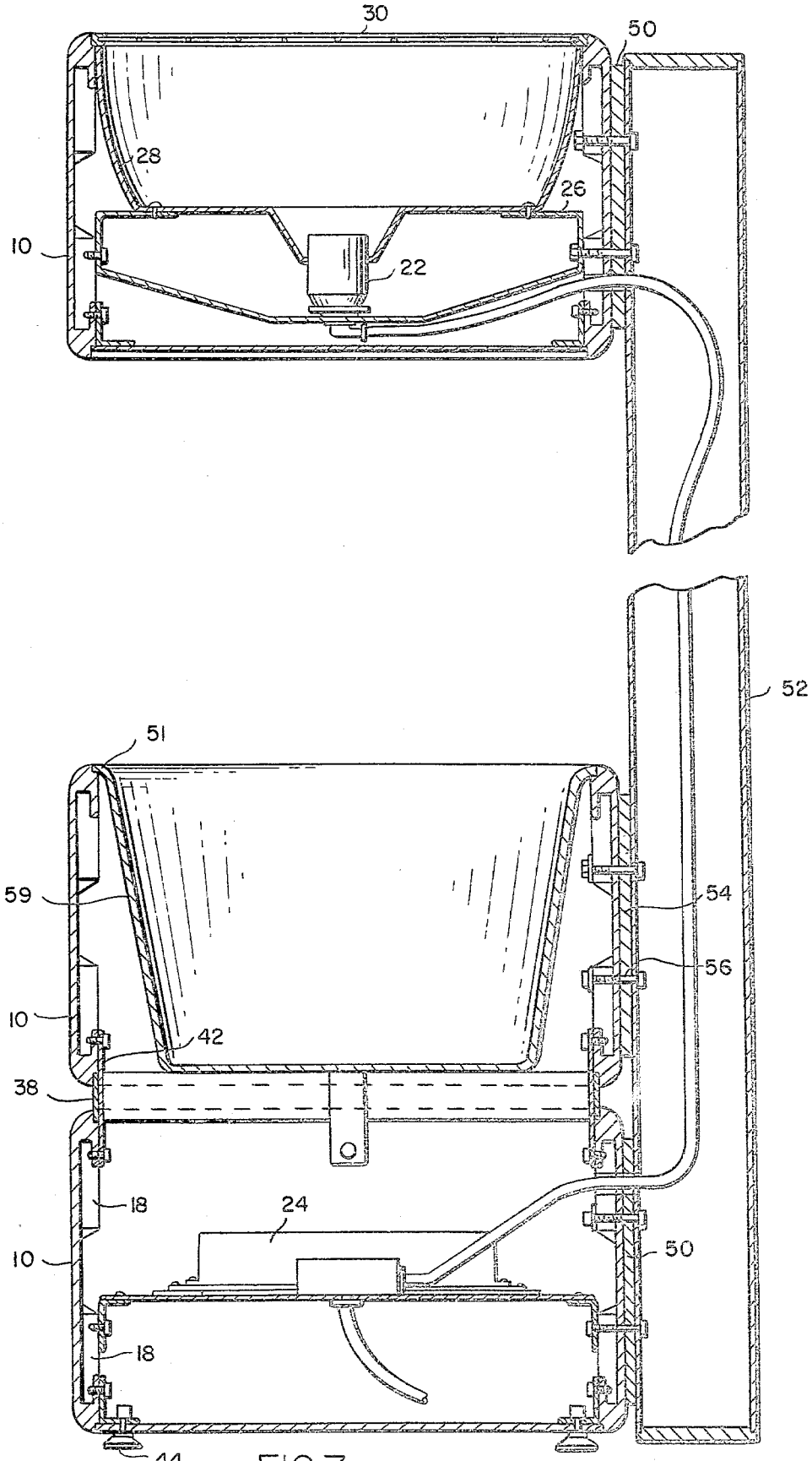

FIG. 6 is a vertical section showing a lamp stand comprised of a stack of four modules with the light-emitting assembly in the top module and the ballast in the bottom module; and FIG. 7 is a vertical section of a lamp stand comprising three modules, two of which are connected one atop the other and to the lower end of a post and the other of which is connected to the top of the post above and in concentric relation with the modules connected to the bottom of the post.

Figure 1:
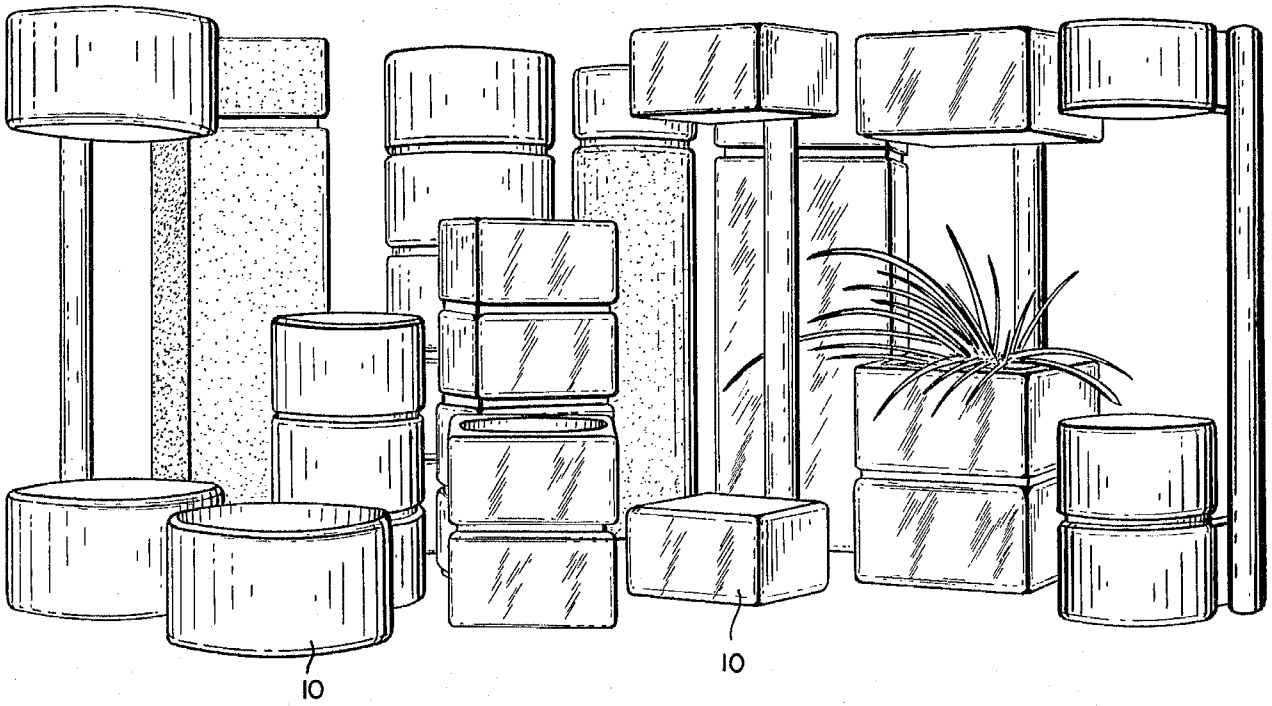
FIG. 1 is a perspective view of a family of modular lamps.

Referring to the drawings, FIG. 1 shows in perspective a family of lamp stands of different cross-sectional configuration and height consisting of different numbers of basic modules designed for indirect lighting and wherein certain of the modules are optionally designed to receive potted plants.

The basic module or unit 10 may be of horizontal circular or rectangular cross-sectional configuration and in accordance with this invention, these basic modules are designed to be used singly as by placing them on a file cabinet, preferably above the level of sight of the average person so as to project light for indirect lighting onto the ceiling or stacked in vertically-spaced relation to provide a floor lamp wherein the bottom module provides support for the lamp and the top module provides a receptacle for receiving an indirect lighting assembly. A single module may be placed atop a module of multiple unit height or one or more modules may be secured to the lower end of a supporting post with a single module attached to the top of the post. Optionally, the lighting assembly may be removed from the top of the lower stack of modules and replaced with a receptacle for receiving a potted plant.

Figure 2:
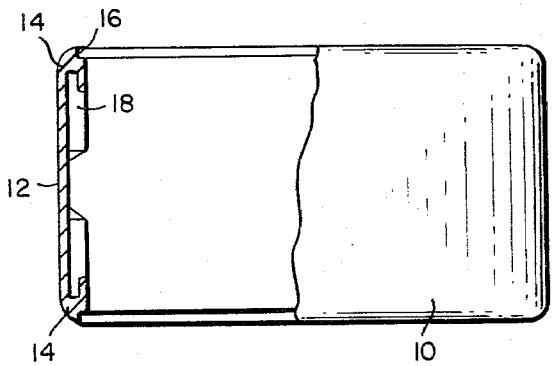
FIG. 2 is an elevation partly in section of a single module.

The modules 10, FIG. 2, are of hollow, thin wall construction and each comprises, as shown, a thin wall 12 of circular or rectangular cross section open at the bottom and at the top. At the bottom and top, there are circumferentially thickened rims 14 thickened inwardly of the outside diameter of the wall, at the inner sides of which there are grooves 16. Inwardly of the grooves there are at equal circumferential distances from each other wall brackets 18. The thickened rims and wall brackets provide rigidity at the top and bottom of the module and means for attaching modules to each other where more than one module is used for construcing the lamp stand.

Figure 3:
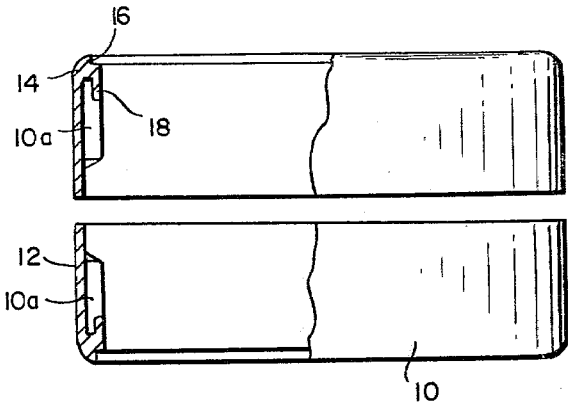
FIG. 3 is an elevation partly in section of two molded halves of a single module positioned for joining to form a whole module.
Figure 4:
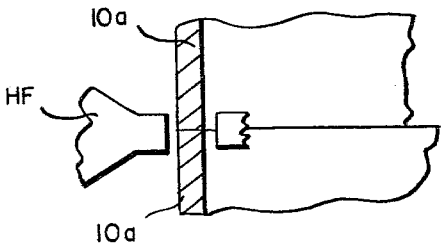
FIG. 4 is a fragmentary section showing bonding of the two half modular sections to each other.

The modules 10 are constructed as shown in FIGS. 2, 3 and 4 by molding two pieces 10*a*—*10a* of identical configuration, placing the two pieces end-to-end with the thickened rims at opposite ends to form a whole module and bonding the abutting edges, for example, by means of a heating process or by solvent bonding or by glueing with suitable adhesives.

Each module 10 as thus constructed comprises a unitary structure which is hollow and open at its ends, symmetrical with respect to its longitudinal axis and has at each open end a reinforcing rim 14, the inner side of which contains a recess 16 which corresponds in cross-sectional configuration to the external surface of the unit, but of smaller cross-sectional area. The ends of each module are molded to have a vertical cross section which is arcuate.

Figure 5:
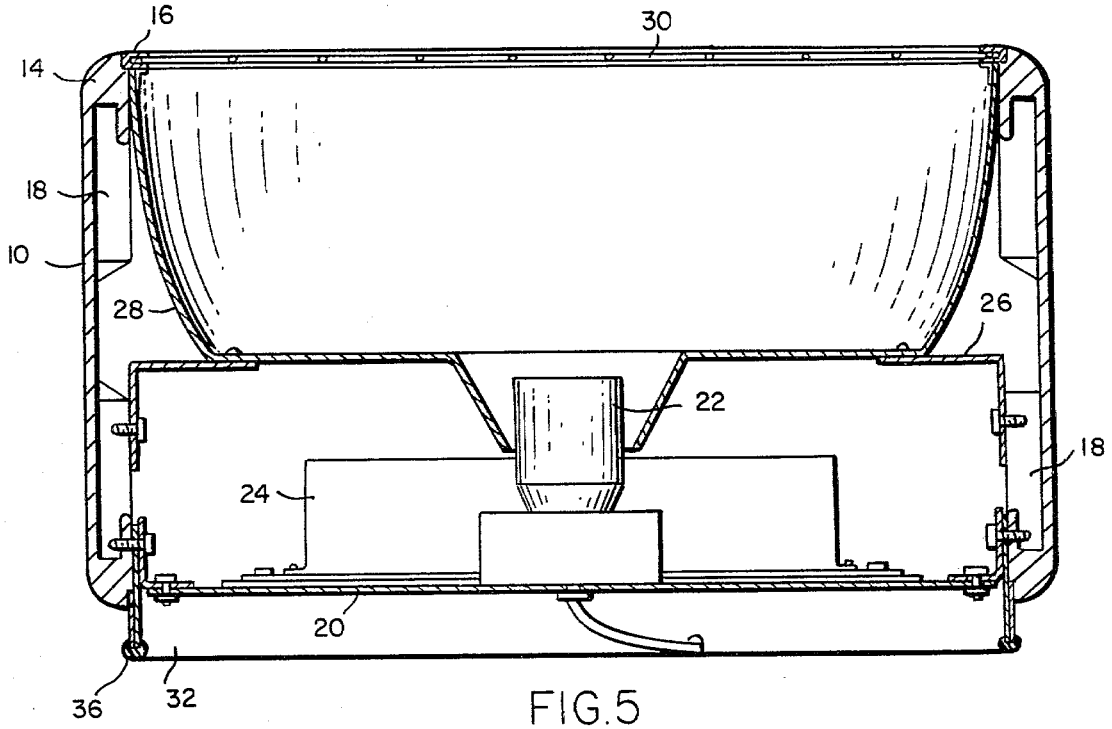
FIG. 5 is a vertical section through a single module showing a lamp receptacle and ballast supported in the lower portion thereof and a reflector and diffuser element supported in the upper portion thereof.

FIG. 5 shows a single module 10 within which there is a support 20 for receiving a lamp socket 22 and ballast 24 and a support 26 for supporting a reflector 28. The supports 20 and 26 are fastened within the module to the wall brackets 18. A lamp protecting element 30 may be mounted in the groove 16 at the top of the module which may be a screen, frosted glass or the like.

As heretofore indicated, such a unit whether of circular or rectangular configuration may be used in a elevated position above normal eye level on office furniture for indirect lighting or may be used in conjunction with other modules stacked to provide a lamp stand comprised of different numbers of modules. When used as a single unit, a support part 32 is fastened within the groove 16 at its lower end to support the unit above the surface of the structure on which it is placed and this part, desirably, is provided with a bead 36 at its lower edge.

Referring specifically to FIG. 6, there is shown a lamp stand comprised of four unit modules 10 stacked one above the other, the lowermost module constituting the base for supporting the stand and the uppermost module constituting a receptacle for a lighting assembly. Lamp stands of five, six or more modules would be similar to FIG. 6. In accordance with the invention, the modules are stacked in vertically spaced relation by means of spacer bands 38 which correspond in diameter to the inside diameter of the grooves 16 positioned between the upper end of the lower one of two stack modules and the lower end of the upper of two stacked modules so as to provide between the modules annular spaces 40 which are continuous peripherally of the stacked modules. The bands 38 are secured in place by rigid plates 42 bolted to the inner sides of the wall brackets 18 over the inner sides of the bands by means of screw bolts 44. As shown, the upper or top module contains a lighting assembly as described with reference to FIG. 5 and the lowermost or bottom module contains the ballast. The lowermost module is also provided with adjustable supporting feet 46 in place of the part 32 which are fastened to the inner sides of the wall brackets 18 by angle members 48.

As heretofore suggested, the space occupied by the lighting assembly comprising the light socket 22 with support 20 and reflector 24 may be replaced by a receptacle for receiving a potted plant. Such a receptacle is shown at 50, FIG. 7, wherein a post 52 is secured at its lower end to a stack of two superimposed modules so as to stand perpendicular thereto and a single module is secured to the top of the post. A lip 51 at the top of the receptacle is dimensioned to fit into the groove 16. For attaching the modules to the post, there are provided saddle plates 54 having inside and outside curved surfaces adapted to conform to the curvature of the side walls of the modules and to the curvature of the posts which are positioned between the modules and the posts. The saddle plates contain openings for receiving fastening bolts 56.

Lamp stands comprised of a single module of multiple unit length and a unit module atop the single module are shown in FIG. 1. The single module is connected to the top of the module of multiple length in the same fashion as that already described by means of a spacer band.

Lamp stands as constructed of the unit modules described herein provide versatility as a family group or individually for home and commercial use, are inexpensive to manufacture and easy to adapt to a specific use.

It should be understood that the present disclosure is for the purpose of illustration only and includes all modifications or improvements which fall within the scope of the appended claims.

We claim:

1. A free-standing modular lamp stand comprising an assembly of light modules of predetermined configuration arranged to be stacked in vertically-spaced relation with spacers positioned between modules of a horizontal section less than the horizontal section of the modules arranged in concentric relation to the modules such that there are outwardly-facing grooves between successive modules, said assembly including a module at the base upon which the lamp stand is designed to rest and a module at the top for providing lighting, said top module defining an upwardly-facing recess and a luminaire assembly mounted in said recess in a position to direct light upwardly through the top opening of the module at the top of the stack of modules.

2. A lamp assembly according to claim 1 wherein said spacers connect the modules.

3. A lamp assembly according to claim 1 wherein said spacers correspond in peripheral configuration to the modules.

4. A lamp assembly according to claim 1 comprising a post and means for fastening the modules to the post.

5. A family of free-standing modular lamp stands wherein certain of the lamp stands are comprised of modules of circular right section and others of rectangular right section and wherein all of the modules of any one lamp are of the same configuration, said modules being adapted to be stacked in vertically-spaced relation with spacers therebetween to provide lamp stands of different height, said spacers being of smaller horizontal section than the modules and defining in conjunction with the ends of the modules outwardly-facing grooves peripherally of the structure and each lamp assembly including a module at the bottom for supporting the lamp stand in an upright position and a module at the top for providing indirect lighting, said latter module having at the top an upwardly-open recess and a light-emitting assembly supported within the recess which directs light upwardly through the open top.

6. A lamp family according to claim 5 wherein the spacer means join the modules.

7. A lamp family according to claim 5 wherein there is a post and means for connecting modules to the base and top of the post in vertically-spaced relation.

8. A family of a plurality of free-standing modular lamp stands comprised of connected modules of different numbers of modules with indirect lighting means recessed into the top at the top modules such that, by arrangement of lamp stands of different heights throughout an area, the desired levels of intensity of the illumination at the work plane can be achieved with a satisfactory range of brightness in the ceiling characterized in that spacers are positioned between successive modules in the stack of modules which secure the modules in rigid alignment and wherein the spacers are of smaller horizontal section than the modules and define in conjunction with the ends of the modules outwardly-facing grooves peripherally of the structure.

9. A free-standing modular indirect lighting system comprised of like modules, each of which is a hollow, thin-walled structure of box-like configuration, a band associated with each module which fits the perimeter thereof, said band being adapted to interconnect two of said modules of like shape in vertically spaced relation by attachment to the respective top and bottom peripheries of each of two adjacent modules, structural members on the inner walls of said modules, means for attaching a band positioned between two adjacent modules to the respective structural members in each module to form an assembly of spaced structural modules and a support recessed within the upper module of a stack of modules.

10. A structure according to claim 9 comprising an indirect lighting assembly mounted to the support recessed within the top unit which directs light upwardly through the open top of the top unit of the stack of units.

11. A structure according to claim 9 wherein a receptacle for a potted plant is mounted on the support recessed into the top unit so that the foliage of the plant projects upwardly through the open top of the top unit of the stack of units.

12. A structure according to claim 9 comprising ballast recessed into the bottom unit of a stack of units.

13. A structure according to claim 9 wherein the modules are of circular horizontal section.

14. A structure according to claim 9 wherein the modules are of rectangular horizontal section.

15. A structure according to claim 9 wherein there are at the respective ends of the modules at the inner side annular grooves for receiving the edges of the spacing bands.

16. A structure according to claim 14 wherein there is a receptacle mounted within the open top of the top unit provided with a peripheral lip designed to be received in the groove at the top of the unit.

17. A structure according to claim 9 wherein there is an annular rib at the inner side of each of the respective ends of each module to which the structural members are attached and there are four such structural members.

18. A structure according to claim 9 comprising a post attached at one end to the side wall of the lowermost module of a stack of modules so as to stand perpendicularly relative thereof and a module attached to the upper end of the post in vertically spaced relation to the uppermost module of the stack of modules.

19. A structure according to claim 9 comprising at the lower end of the lowermost module adjustable mounted feet.

20. A free-standing modular indirect lighting system comprising a module of multiple unit length and a unit module atop the module of multiple unit length, a spacer band associated with each of the modules which fits the perimeters thereof, said spacer band being adapted to interconnect the two modules in vertically-spaced relation by attaching the respective top and bottom peripheries of each of the modules, said spacers in conjunction with the adjacent ends of the modules with which they are associated defining outwardly-facing circumferential grooves, structural members on the inner walls of said modules, means for attaching the band positioned between the modules to the respective structural members to form an assembly of spaced structural modules wherein the unit module is supported atop the module of multiple unit length, said unit module at the top being adapted to receive a support within which an indirect lighting assembly is mounted so as to direct light upwardly through the open top of the unit module at the top.

21. Modules for constructing a free-standing modular lamp stand according to claim 9, each module being comprised of two identically molded half sections butt-welded to each other.

22. A free-standing modular lamp assembly comprising an arrangement of a plurality of modules, means connecting the modules in vertically-spaced concentric relation, said means in conjunction with the adjacent ends of the modules with which they are associated defining outwardly-facing peripheral grooves.

23. A basic module for a family of modular lamps comprising a hollow box-like structure having two like molded halves, the molded form of which has at one rim structural members symmetrically positioned such that when two halves are bonded together at the other rim of each half to make a module the structural members are located to mate to join with two adjacent modules on either side.

24. A free-standing modular lamp stand comprising an assembly of modules of predetermined configuration arranged to be stacked, said assembly including a module at the base upon which the lamp stand is designed to rest and a module at the top for providing indirect lighting, said top module defining an upwardly-facing recess, a luminaire assembly mounted in said recess in a position to direct light upwardly through the top opening of the module at the top of the stack and spacers situated between and connecting the ends of adjacent modules, said spacers being of smaller horizontal section than the ends of the modules and defining with said ends annular outwardly-facing grooves peripherally of the structure at intervals heightwise of the structure which emphasize the modular composition of the structure, and wherein each module contains at its ends internally-positioned recesses corresponding in horizontal section to the external horizontal sections to the spacers within which the ends of the spacers are telescopically lodged and wherein the combined axial length of the recesses in adjacent pairs of modules is less than the axial length of a spacer and inextensible means positioned internally of the modules and spacers, said inextensible means spanning the spacers and being secured to the modules.

25. A free-standing modular lamp stand according to claim 24 wherein the side walls of the modules are radiused at their ends so that the grooves defined by the spacers and ends of the side walls flare outwardly.

26. A structure according to claim 24 comprising a stack of modules in which the modules are positioned in succession in the stack.

27. A structure according to claim 24 wherein there is an interval in the stack of modules of at least one module between the top and bottom.

* * * * *